US009538784B1

(12) United States Patent
Al-Hasan

(10) Patent No.: US 9,538,784 B1
(45) Date of Patent: Jan. 10, 2017

(54) MULTIPURPOSE ASHTRAY HOLDER

(71) Applicant: Khaled Jafar Al-Hasan, Safat (KW)

(72) Inventor: Khaled Jafar Al-Hasan, Safat (KW)

( * ) Notice: Subject to any disclaimer, the term of this patent is extended or adjusted under 35 U.S.C. 154(b) by 0 days.

(21) Appl. No.: 15/092,583

(22) Filed: Apr. 6, 2016

(51) Int. Cl.

| | |
|---|---|
| ***A24F 19/14*** | (2006.01) |
| ***A24F 19/10*** | (2006.01) |
| ***B65D 21/08*** | (2006.01) |
| ***B65D 85/00*** | (2006.01) |
| ***B65D 1/34*** | (2006.01) |
| ***A24F 19/00*** | (2006.01) |

(52) U.S. Cl.
CPC ..... *A24F 19/10* (2013.01); *A24F 19/0035* (2013.01); *A24F 19/0071* (2013.01); *A24F 19/0078* (2013.01); *B65D 1/34* (2013.01); *B65D 21/086* (2013.01); *B65D 85/70* (2013.01)

(58) Field of Classification Search
CPC ..... E05D 3/12; B65D 85/28
USPC ..... 206/246; 220/817
See application file for complete search history.

(56) References Cited

U.S. PATENT DOCUMENTS

| | | | | |
|---|---|---|---|---|
| D157,150 | S | 2/1950 | Hanson | |
| 2,633,136 | A * | 3/1953 | Nesvig | A24F 19/12 131/235.1 |
| D202,459 | S | 9/1965 | Aro | |
| D258,149 | S | 2/1981 | Bobbish | |
| 5,761,753 | A | 6/1998 | Talbert | |
| 2011/0284416 | A1 | 11/2011 | Sowers et al. | |
| 2014/0318992 | A1* | 10/2014 | Morelli Carullo | B65D 5/327 206/6.1 |

FOREIGN PATENT DOCUMENTS

| | | | | |
|---|---|---|---|---|
| CN | 201158265 Y | | 12/2008 | |
| CN | 201986686 U | | 9/2011 | |
| CN | 202135708 U | | 2/2012 | |
| FR | 36554 E | * | 7/1930 | A24F 19/14 |
| FR | 2335164 A1 | * | 7/1977 | A24F 19/0014 |
| GB | 747165 A | * | 3/1956 | A24F 19/00 |
| PL | DE 202015004403 U1 | * | 7/2015 | A45C 11/36 |

OTHER PUBLICATIONS

DE_202015004403translation.pdf.*
FR_36554_translation.pdf.*

* cited by examiner

*Primary Examiner* — J. Gregory Pickett
*Assistant Examiner* — Allan Stevens
(74) *Attorney, Agent, or Firm* — Richard C. Litman

(57) ABSTRACT

The multipurpose ashtray holder may be used as a general purpose ashtray or a holder for stationery products. The multipurpose ashtray holder includes a holder assembly for placement at select locations by the user, an ashtray assembly, and a connector pivotally connecting the holder assembly to the ashtray assembly so as to enable folding of the multipurpose ashtray holder between a closed, non-use state and an open, use state. The holder assembly has a holder body with a plurality of insert holes therein. The insert holes enable quick and safe extinguishing of flammable tobacco products or storage of elongate objects or office supplies. The ashtray assembly includes a tray with a plurality of spaced notches formed thereon. The tray enables collection of ash or office supplies and caps the holder assembly in the closed state.

9 Claims, 5 Drawing Sheets

MULTIPURPOSE ASHTRAY HOLDER

BACKGROUND OF THE INVENTION

1. Field of the Invention

The present invention relates to tobacco accessories, and particularly to a multipurpose ashtray holder foldable between use and non-use configurations, to facilitate the disposition of ash and tobacco products in a safe manner, and/or containment of stationery products.

2. Description of the Related Art

Most conventional ashtrays are relatively simple in design and function. These ashtrays usually comprise a tray with a plurality of notches spaced around a peripheral wall of the tray. The user disposes ashes into the collection basin of the tray and the notches hold tobacco products, such as cigarettes and cigars, thereon.

Conventional ashtrays, however, do not have any means of minimizing potential fire injuries to the user and/or fire hazards to the surroundings, that may be created by the burning end of the tobacco product. In most instances, the user simply stubs or taps the burning end of the tobacco product against the surface of the basin to extinguish the tobacco product. This often times requires several taps or even excessive press of the tobacco product into the tray. In case of the former, stray hot or burning ash may be expelled from the tray and thus come into contact with a flammable surface or object, which may lead to an unintentional fire and consequences thereof. In case of the latter, the user could easily burn the fingers or hand during the process.

Apart from the potential dangers, most conventional ashtrays serve a singular purpose, i.e., they are designed for disposing of tobacco products. These ashtrays become unassuming decorative accents of a home or office when not in use.

In light of the above, it would be a benefit in the art of tobacco accessories to provide a device that safely disposes tobacco products and perform additional functions. Thus, a multipurpose ashtray holder solving the aforementioned problems is desired.

SUMMARY OF THE INVENTION

The multipurpose ashtray holder may be used as a general purpose ashtray or a holder for stationery products. The multipurpose ashtray holder includes a holder assembly for placement at select locations by the user, an ashtray assembly, and a connector pivotally connecting the holder assembly to the ashtray assembly so as to enable folding of the multipurpose ashtray holder between a closed, non-use state and an open, use state. The holder assembly has a holder body with a plurality of insert holes thereon. The insert holes enable quick and safe extinguishing of flammable tobacco products or storage of elongate objects or office supplies. The ashtray assembly includes a tray with a plurality of spaced notches formed thereon. The tray enables collection of ash or office supplies and caps the holder assembly in the closed state.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
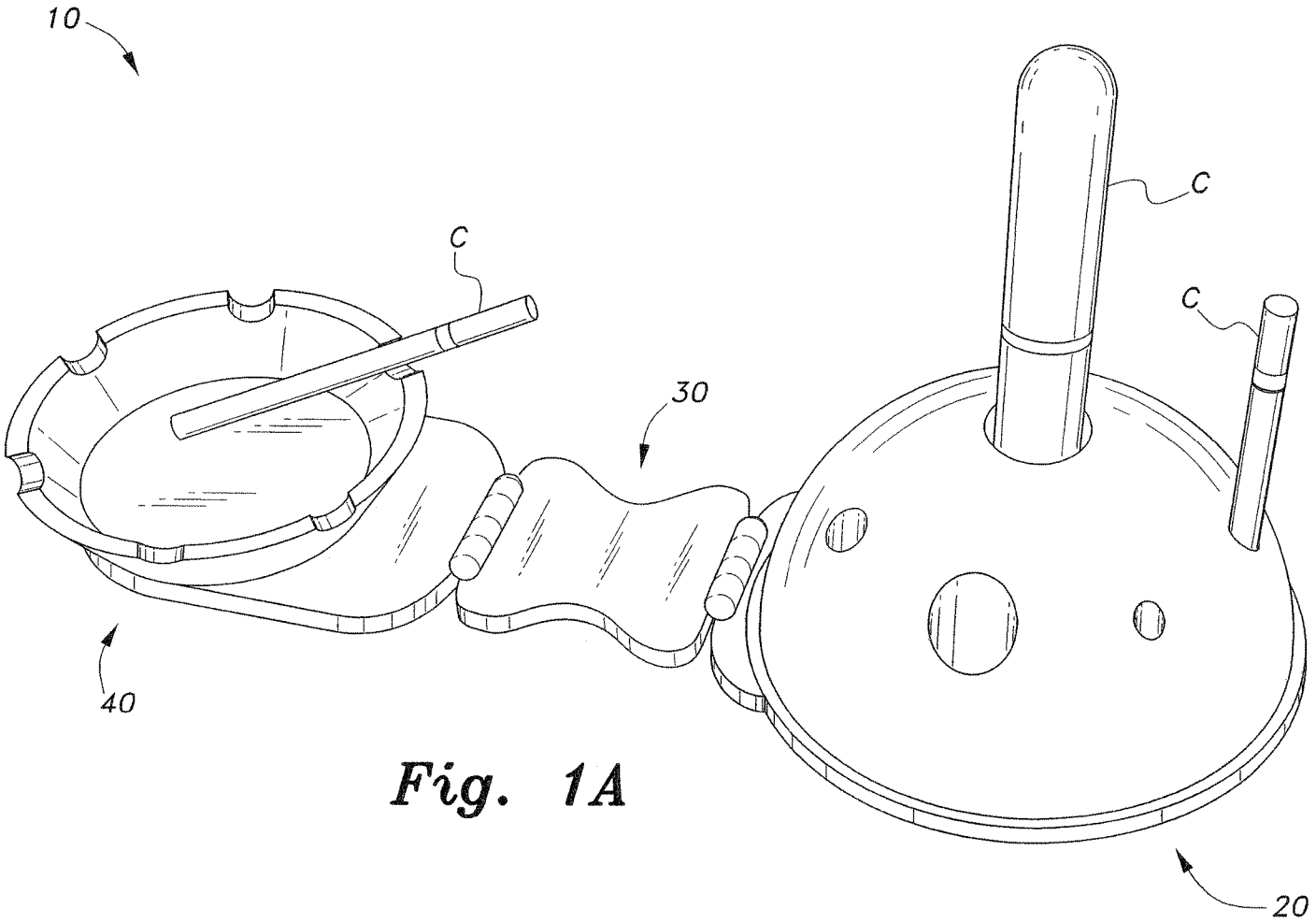
FIG. 1A is an environmental, perspective view of a multipurpose ashtray holder according to the present invention, multipurpose ashtray holder serving as an ashtray.
Figure 1B:
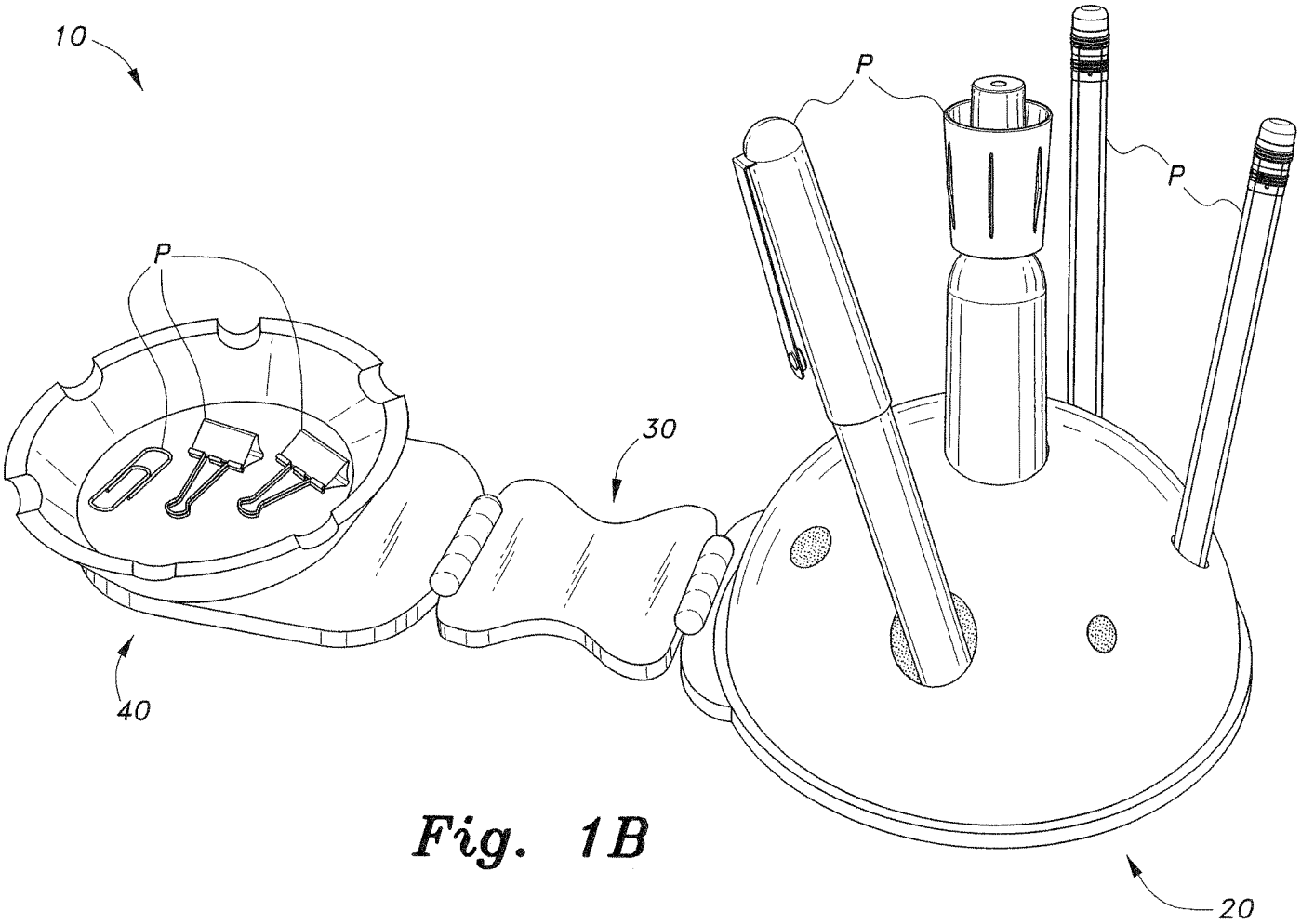
FIG. 1B is an environmental, perspective view of the multipurpose ashtray holder shown in FIG. 1A, the multipurpose ashtray holder serving as an office supplies holder.

The multipurpose ashtray holder, generally referred to by the reference number 10 in the Figures, provides features that permit the multipurpose ashtray holder 10 to function as an ashtray as well as a holder for storing stationery products. As shown in FIGS. 1A, 1B, and FIGS. 2-4, the multipurpose ashtray holder 10 includes a holder assembly 20, a connector 30 with one end of a connector 30 pivotally coupled to the holder assembly 20, and an ashtray assembly 40 pivotally coupled to the other end of the connector 30.

The holder assembly 20 serves as a base for the multipurpose ashtray holder 10, which enables placement of the multipurpose ashtray holder 10 at any desired location. The holder assembly 20 includes a relatively circular or elongate holder base 21 and a holder body 22 disposed on the holder base 21. The holder base 21 is preferably constructed as a generally elongate, flat, circular member or plate suitable for stable resting on surfaces as well as a support for the holder body 22. The holder body 22 is preferably dome-shaped to conform to the shape of the holder base 21 and provide structure for holding various items therein.

As shown in the Figures, a plurality of columnar or cylindrical insert holes 23*a*, 23*b*, 23*c*, 23*d* extend into the holder body 22 to a preselected depth. The insert holes 23*a*, 23*b*, 23*c*, 23*d* may extend perpendicular to the holder base 21, as shown in the Figures, radially from preselected points within the holder body 22, or a combination thereof. The main portion of the holder body 22 may also be generally hollow or solid. Each of these insert holes 23*a*, 23*b*, 23*c*, 23*d* may be same or different in diameter. More preferably, at least a pair of the insert holes 23*a*, 23*b*, 23*c*, 23*d* are of the same diameter. The diameter of the insert holes 23*a*, 23*b*, 23*c*, 23*d* generally conform to the standard diameter of various tobacco products C, such as cigarettes and cigars, or office supplies P, such as writing implements and pointers.

When used as an ashtray, the insert holes 23*a*, 23*b*, 23*c*, 23*d* permit the user to safely extinguish the burning end or butt of the tobacco product by inserting the butt into the appropriate sized insert hole 23*a*, 23*b*, 23*c*, 23*d* (see FIG. 1A) and tamping or pressing the tobacco product within the insert hole 23*a*, 23*b*, 23*c*, 23*d*. This action confines or encloses the butt of the tobacco product within the respective insert hole 23*a*, 23*b*, 23*c*, 23*d* such that the user's fingers do not touch this end during the process thereby eliminating or substantially reducing the potential dangers of stray hot ash, burnt fingers, and other potential fire hazards. Moreover, this extinguishing action facilitated by the insert holes 23*a*, 23*b*, 23*c*, 23*d* reduces much of the potential smoke that can be produced during a conventional extinguishing process due, in part, to the swiftness in which the butt can be extinguished within a confined space. The insert holes 23*a*, 23*b*, 23*c*, 23*d* may also be used to hold whole or partially smoked tobacco products therein.

When used as a holder for stationery products, the insert holes 23*a*, 23*b*, 23*c*, 23*d* permit insertion of various office supplies P such as pencils, pens, markers, as well as pointers and the like into a corresponding, suitably sized hole. The depth of the insert holes 23*a*, 23*b*, 23*c*, 23*d* is sufficiently deep enough to support most elongate objects therein.

Figure 2:
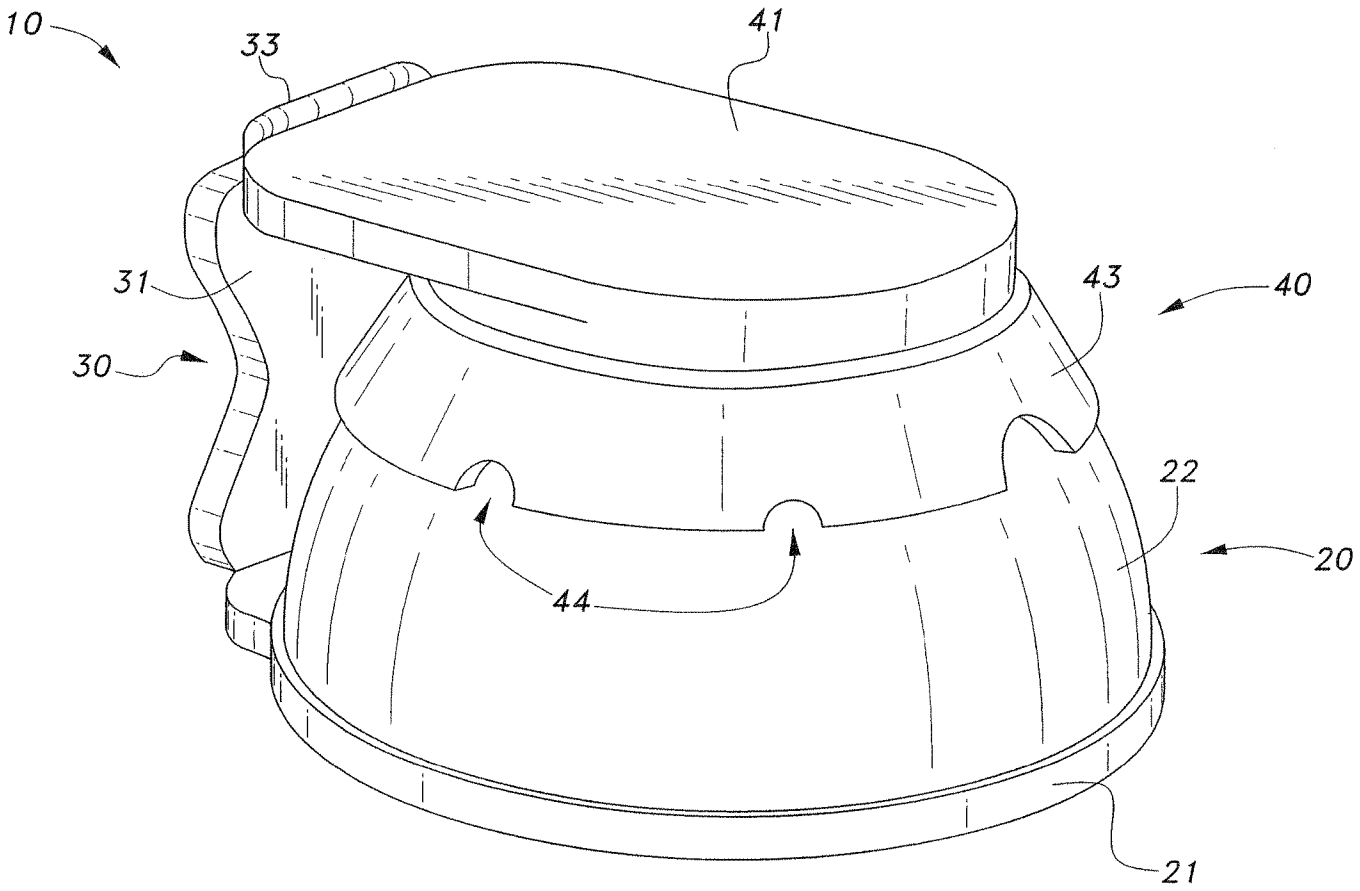
FIG. 2 is a perspective view of the multipurpose ashtray holder shown in FIGS. 1A and 1B in a folded state.
Figure 3:
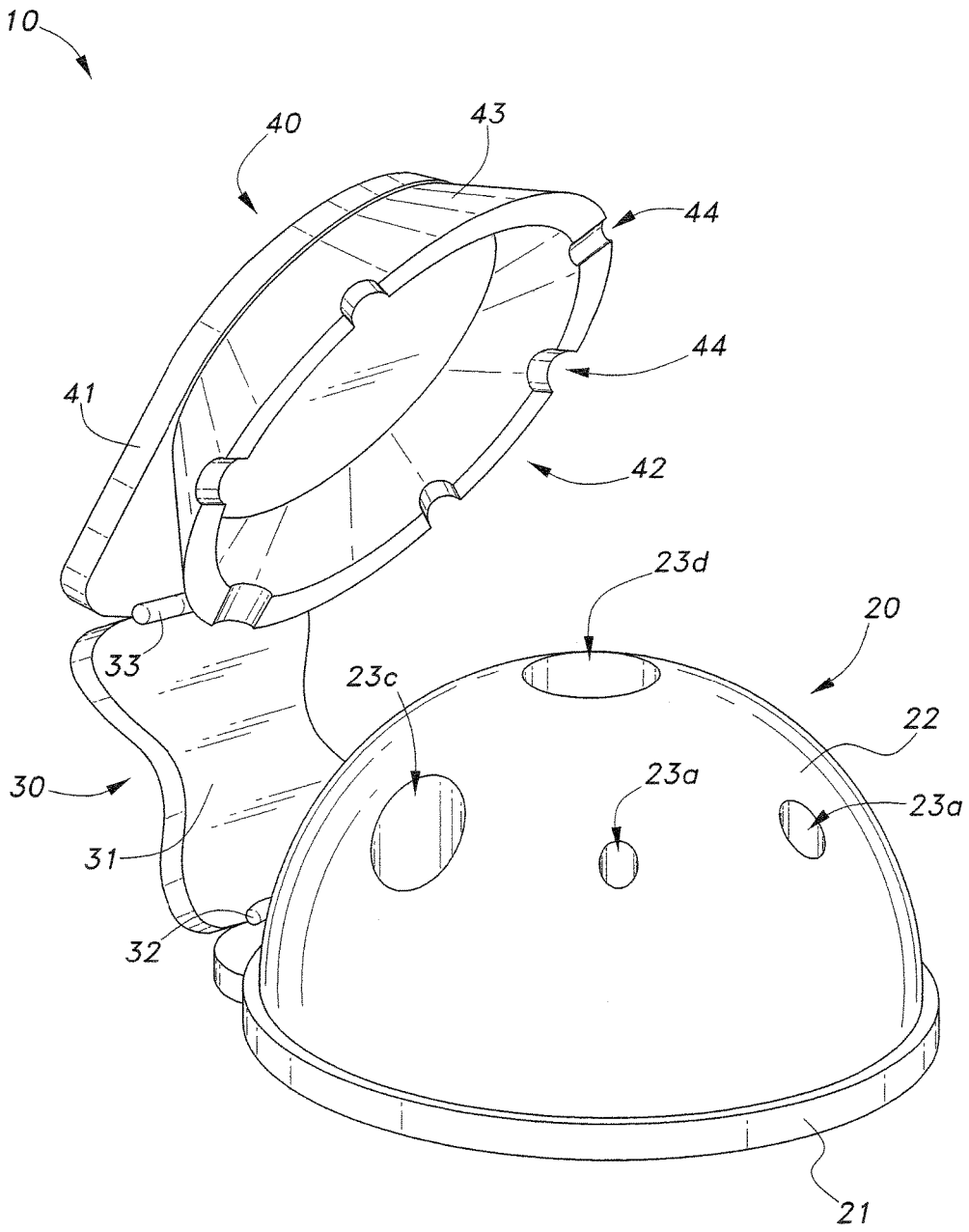
FIG. 3 is a perspective view of the multipurpose ashtray holder shown in FIG. 2 in a partially unfolded state.
Figure 4:
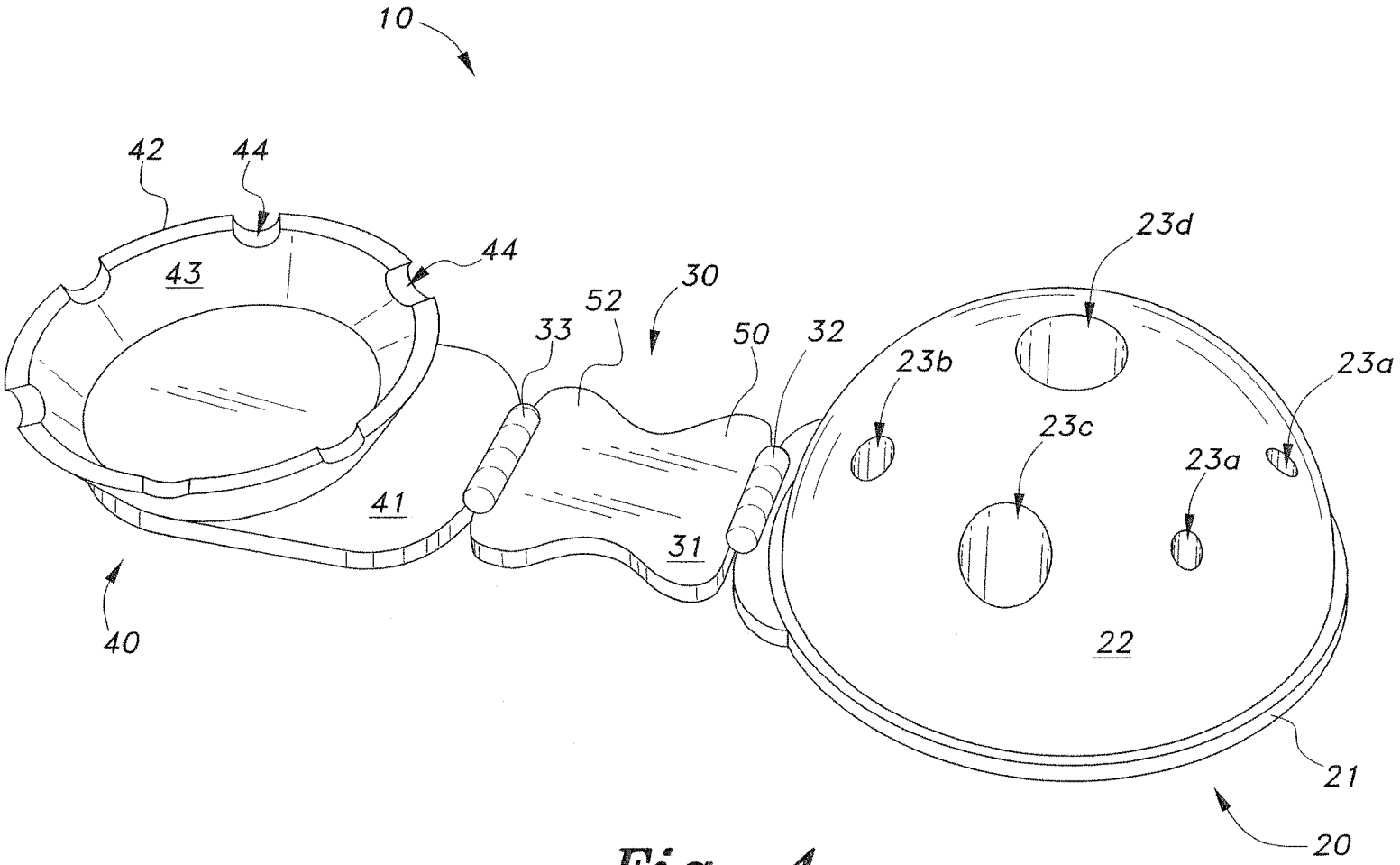
FIG. 4 is a perspective view of the multipurpose ashtray holder shown in FIG. 2 in a fully unfolded state.

The connector 30 includes an elongate member or plate 31 with a first hinge 32 at one end 50 and a second hinge 33 at the other end 52. The first hinge 32 pivotally couples the connector 30 to the holder assembly 20 while the second hinge 33 pivotally couples the connector 30 to the ashtray assembly 40. The elongate member 31 may have a generally hourglass shape as a suitable lightweight, durable configuration. This construction of the connector 30 acts as a double hinge enabling the ashtray assembly 40 to fold over the holder assembly 20 between a first or folded, non-use position or state, to a second or an unfolded, use position or state as shown in FIGS. 2-4. Due to the relative height of the holder assembly 20, the double hinge of the connector 30 has a sufficient length to provide the height needed for the ashtray assembly 40 to fold over the holder assembly 20 into a compact form as shown in FIG. 2.

The ashtray assembly 40 includes a relatively elongate ashtray base 41 with a tray 42 disposed thereon. The ashtray base 41 serves as a support for the tray 42 when the multipurpose ashtray holder 10 is unfolded into the use state. An upstanding generally annular wall 43 extends from the ashtray base 41 forming a bowl or basin of the tray 42 in conjunction with the ashtray base 41 for collecting objects therein during use. A plurality of spaced notches 44 are formed on the upper rim of the annular wall 43. The notches 44 enable tobacco products C or any elongate object to rest thereon as shown in FIG. 1A. The annular wall 43 may extend at an angle with respect to the ashtray base 41, forming a generally frustoconical wall that generally conforms to the curvature of the dome shaped holder body 22. This can be seen in FIG. 2 where the tray 42 caps the holder body 22 when the multipurpose ashtray holder 10 is folded into a compact form factor. It is contemplated that the angular disposition of the annular wall 43 can be varied as long as the annular wall 43 enables a relatively compact form in the folded state.

When used as an ashtray, the tray 42 acts as a conventional ashtray where spent ash is collected and cigarettes and/or cigars rest on the notches 44 as shown in FIG. 1. When used as a holder for stationery products, the tray 42 stores various office supplies P, such as clips, tacks, and the like.

Thus, it can be seen that the multipurpose ashtray holder 10 has a plurality of uses. As a general purpose ashtray, the holder assembly 20 enables safe extinguishing and holding of tobacco products C while the ashtray assembly 40 facilitates collection of ash and resting of burning cigarettes or cigars. As a holder for stationery products, the holder assembly 20 stores various writing implements and the ashtray assembly 40 stores other office peripherals. When not in use, the multipurpose ashtray holder 10 may be folded into a compact form for storage and transport.

It is noted that the multipurpose ashtray holder 10 encompasses a variety of alternatives. For example, the multipurpose ashtray holder 10 should not be construed as limited to use for tobacco and stationery products. The multipurpose ashtray holder 10 may facilitate holding of various elongated objects as well as small objects that fit in the tray 42. The multipurpose ashtray holder 10 is preferably constructed from heat resistant materials such as various metals, silicon-based plastics, and the like. These usually exhibit suitable durability while being resistant to the temperatures of burning tobacco.

It is to be understood that the present invention is not limited to the embodiments described above, but encompasses any and all embodiments within the scope of the following claims.

I claim:

1. A multipurpose ashtray holder, consisting of:

a holder assembly having a holder base adapted for placement on a select surface and a holder body disposed on the holder base, the holder base having a shape, the holder body being a dome-shaped member generally conforming to the shape of said holder base, the holder body having at least one insert hole extending into the holder body to a preselected depth, the at least one insert hole adapted to hold elongate objects therein;

an elongate planar connector having one end pivotally coupled to the holder base; and an ashtray assembly pivotally coupled to an opposite end of the connector, the ashtray assembly having an ashtray base and a tray disposed on the ashtray base configured to collect and hold objects therein, the tray having an annular wall substantially frustoconical in shape to cap and conform to said dome-shaped member, the planar connector defining a double hinge between the holder assembly and the ashtray assembly;

wherein the holder assembly and the ashtray assembly are foldable with respect to each other between a compact closed, non-use state and an elongate open, use state to be used as a safe holder to hold a product therein, the tray conforming to the holder body when the multipurpose ashtray holder is folded into the compact closed, non-use state.

2. The multipurpose ashtray holder according to claim 1, wherein said holder base defines a substantially flat circular member.

3. The multipurpose ashtray holder according to claim 1, wherein said at least one insert hole comprises a plurality of insert holes each having a predetermined configuration, each insert hole configured to receive a product therein.

4. The multipurpose ashtray holder according to claim 3, wherein at least one pair of said plurality of insert holes has same sized openings.

5. The multipurpose ashtray holder according to claim 3, wherein at least one of said plurality of insert holes has a different sized opening from the remainder.

6. The multipurpose ashtray holder according to claim 3, wherein said plurality of insert holes radiates from preselected points within said holder body.

7. The multipurpose ashtray holder according to claim 1, wherein said connector defines an elongate flat member having a first hinge at one end and a second hinge at the opposite end, the first hinge being coupled to said holder assembly and the second hinge being coupled to said ashtray assembly.

8. The multipurpose ashtray holder according to claim 7, wherein said elongate member has a substantially hourglass shape.

9. The multipurpose ashtray holder according to claim 1, wherein said tray comprises said annular wall extending from said ashtray base defining a basin for collecting objects therein, and a plurality of spaced notches formed on a rim of said annular wall to hold a portion of individual elongate objects thereon.

* * * * *